US007073594B2

(12) United States Patent
Stegemeier et al.

(10) Patent No.: US 7,073,594 B2
(45) Date of Patent: Jul. 11, 2006

(54) WIRELESS DOWNHOLE WELL INTERVAL INFLOW AND INJECTION CONTROL

(75) Inventors: George Leo Stegemeier, Houston, TX (US); Harold J. Vinegar, Houston, TX (US); Robert Rex Burnett, Katy, TX (US); William Mountjoy Savage, Houston, TX (US); Frederick Gordon Carl, Jr., Houston, TX (US); John Michele Hirsch, Houston, TX (US)

(73) Assignee: Shell Oil Company, Houston, TX (US)

( * ) Notice: Subject to any disclaimer, the term of this patent is extended or adjusted under 35 U.S.C. 154(b) by 65 days.

(21) Appl. No.: 10/220,453

(22) PCT Filed: Mar. 2, 2001

(86) PCT No.: PCT/US01/06802

§ 371 (c)(1),
(2), (4) Date: Aug. 29, 2002

(87) PCT Pub. No.: WO01/65063

PCT Pub. Date: Sep. 7, 2001

(65) Prior Publication Data

US 2003/0066652 A1 Apr. 10, 2003

Related U.S. Application Data

(60) Provisional application No. 60/186,393, filed on Mar. 2, 2000.

(51) Int. Cl.
*E21B 23/00* (2006.01)
*E21B 43/00* (2006.01)
*E21B 34/06* (2006.01)

(52) U.S. Cl. ..... 166/369; 166/53; 166/66.6; 166/73; 166/242.1; 166/250.15; 166/373

(58) Field of Classification Search ..... 166/248, 166/250.01, 250.07, 250.15, 250.17, 369, 166/373, 381, 386, 387, 53, 65.1, 66, 66.4, 166/66.6, 242.1, 72, 73
See application file for complete search history.

(56) References Cited

U.S. PATENT DOCUMENTS 525,663 A 9/1894 Mottinger (Continued)

FOREIGN PATENT DOCUMENTS

EP 28296 5/1981

(Continued)

OTHER PUBLICATIONS

Brown. Connolizo and Robertson, West Texas Oil Lifting Short Course and H.W. Winkler, "Misunderstood or overlooked Gas-Lift Design and Equipment Considerations," SPE, p. 351 (1994).

(Continued)

*Primary Examiner*—Jennifer H. Gay
(74) *Attorney, Agent, or Firm*—Rachel Stiegel

(57) ABSTRACT

An apparatus and methods of electrically controlling downhole well interval inflow and/or injection. The downhole controllable well section having a communications and control module, a sensor, an electrically controllable valve and an induction choke. The electrically controllable valve is adapted to regulate flow between an exterior of the tubing and an interior of the tubing. Power and signal transmission between surface and downhole is carried out via the tubing and/or the casing. When there are multiple downhole controllable well sections, flow inhibitors separate the well sections.

32 Claims, 5 Drawing Sheets

U.S. PATENT DOCUMENTS 2,379,800 A * 7/1945 Hare ..... 336/105
2,414,719 A * 1/1947 Cloud ..... 333/177
2,917,004 A 12/1959 Davis et al.
3,083,771 A 4/1963 Chapman
3,247,904 A 4/1966 Wakefield, Jr.
3,427,989 A 2/1969 Bostock et al.
3,566,963 A 3/1971 Blackledge
3,602,305 A 8/1971 Kisling, III
3,732,728 A 5/1973 Fitzpatrick ..... 73/151
3,793,632 A 2/1974 Still ..... 340/18
3,814,545 A 6/1974 Waters ..... 417/90
3,837,618 A 9/1974 Juhel ..... 251/129
3,980,826 A 9/1976 Widmer ..... 178/68
4,068,717 A 1/1978 Needham ..... 166/272
4,087,781 A 5/1978 Grossi et al. ..... 340/18
4,295,795 A 10/1981 Gass et al. ..... 417/111
4,393,485 A 7/1983 Redden ..... 367/25
4,468,665 A 8/1984 Thawley et al. ..... 340/856
4,545,731 A 10/1985 Canalizo et al. ..... 417/86
4,566,534 A * 1/1986 Going, III ..... 166/66.7
4,576,231 A 3/1986 Dowling et al. ..... 166/248
4,578,675 A 3/1986 MacLeod ..... 340/855
4,596,516 A 6/1986 Scott et al. ..... 417/58
4,630,243 A 12/1986 MacLeod ..... 367/82
4,648,471 A 3/1987 Bordon ..... 175/4.55
4,662,437 A 5/1987 Renfro ..... 166/65.1
4,681,164 A 7/1987 Stacks ..... 166/304
4,709,234 A 11/1987 Forehand et al. ..... 340/856
4,738,313 A 4/1988 McKee ..... 166/372
4,739,325 A 4/1988 MacLeod ..... 340/854
4,839,644 A 6/1989 Safinya et al. ..... 340/854
4,852,648 A * 8/1989 Akkerman et al. ..... 166/66.4
4,886,114 A 12/1989 Perkins et al. ..... 166/65.1
4,901,069 A 2/1990 Veneruso ..... 340/853
4,972,704 A 11/1990 Wellington et al. ..... 73/155
4,981,173 A 1/1991 Perkins et al. ..... 166/66.4
5,001,675 A 3/1991 Woodward ..... 367/13
5,008,664 A 4/1991 More et al. ..... 340/854
5,130,706 A 7/1992 Van Steenwyk ..... 340/854.6
5,134,285 A 7/1992 Perry et al. ..... 250/269
5,160,925 A 11/1992 Dailey et al. ..... 340/853.3
5,162,740 A 11/1992 Jewell ..... 324/347
5,172,717 A 12/1992 Boyle et al. ..... 137/155
5,176,164 A 1/1993 Boyle ..... 137/155
5,191,326 A 3/1993 Montgomery ..... 340/855.5
5,230,383 A 7/1993 Pringle et al. ..... 166/66.4
5,236,048 A * 8/1993 Skinner et al. ..... 166/382
5,246,860 A 9/1993 Hutchins et al. ..... 436/27
5,251,328 A 10/1993 Shaw ..... 455/73
5,257,663 A 11/1993 Pringle et al. ..... 166/66.4
5,267,469 A 12/1993 Espinoza ..... 73/40.5
5,278,758 A 1/1994 Perry et al. ..... 364/422
5,331,318 A 7/1994 Montgomery ..... 340/855.4
5,353,627 A 10/1994 Diatschenko et al. ..... 73/19.03
5,358,035 A 10/1994 Grudzinski ..... 166/53
5,367,694 A 11/1994 Ueno ..... 395/800
5,394,141 A 2/1995 Soulier ..... 340/854.4
5,396,232 A 3/1995 Mathieu et al. ..... 340/854.5
5,425,425 A 6/1995 Bankston et al. ..... 166/377
5,447,201 A 9/1995 Mohn
5,458,200 A 10/1995 Lagerlef et al. ..... 166/372
5,467,083 A 11/1995 McDonald et al. ..... 340/854.6
5,473,321 A 12/1995 Goodman et al. ..... 340/854.9
5,493,288 A 2/1996 Henneuse ..... 340/854.4
5,531,270 A 7/1996 Fletcher et al. ..... 166/53
5,561,245 A 10/1996 Georgi et al. ..... 73/152.02
5,574,374 A 11/1996 Thompson et al. ..... 324/338
5,576,703 A 11/1996 MacLeod et al. ..... 340/854.4
5,587,707 A 12/1996 Dickie et al. ..... 340/870.09
5,592,438 A 1/1997 Rorden et al. ..... 367/83
5,662,165 A 9/1997 Tubel et al. ..... 166/250.01
5,723,781 A 3/1998 Pruett et al. ..... 73/152.18
5,730,219 A 3/1998 Tubel et al. ..... 66/250.01
5,745,047 A 4/1998 Van Gisbergen et al. 340/853.1
5,782,261 A 7/1998 Becker et al. ..... 137/155
5,797,453 A 8/1998 Hisaw ..... 166/117.5
5,881,807 A 3/1999 Boe et al. ..... 166/100
5,883,516 A 3/1999 Van Steenwyk et al. .... 324/366
5,887,657 A 3/1999 Bussear et al. ..... 166/336
5,896,924 A 4/1999 Carmody et al. ..... 166/53
5,934,371 A 8/1999 Bussear et al. ..... 166/53
5,937,945 A 8/1999 Bussear et al. ..... 166/250.15
5,941,307 A 8/1999 Tubel ..... 166/313
5,955,666 A 9/1999 Mullins
5,959,499 A 9/1999 Khan et al. ..... 330/149
5,960,883 A 10/1999 Tubel et al.
5,963,090 A 10/1999 Fukuchi ..... 330/149
5,971,072 A 10/1999 Huber et al. ..... 166/297
5,975,204 A 11/1999 Tubel et al. ..... 166/250.15
5,995,020 A 11/1999 Owens et al. ..... 340/854.9
6,012,015 A 1/2000 Tubel ..... 702/6
6,012,016 A 1/2000 Bilden et al. ..... 702/12
6,070,608 A 6/2000 Pringle ..... 137/155
6,123,148 A 9/2000 Oneal
6,148,915 A 11/2000 Mullen et al.
6,189,621 B1 * 2/2001 Vail, III ..... 166/385
6,192,983 B1 2/2001 Neuroth et al. ..... 166/250.15
6,208,586 B1 3/2001 Rorden et al. ..... 367/35
6,334,486 B1 1/2002 Carmody et al. ..... 166/53
6,484,800 B1 11/2002 Carmody et al. ..... 166/53
6,633,164 B1 * 10/2003 Vinegar et al. ..... 324/355
6,633,236 B1 * 10/2003 Vinegar et al. ..... 340/854.4
6,662,875 B1 * 12/2003 Bass et al. ..... 166/369
2003/0056952 A1 * 3/2003 Stegemeier et al. ... 166/250.12
2003/0066652 A1 * 4/2003 Stegemeier et al. ..... 166/373

FOREIGN PATENT DOCUMENTS

EP 295178 12/1988
EP 339825 A1 11/1989
EP 492856 A2 7/1992
EP 0 641 916 A2 8/1994
EP 681090 A2 11/1995
EP 697500 A2 2/1996
EP 919696 A2 6/1996
EP 721053 A1 7/1996
EP 732053 A1 9/1996
EP 0 922 835 A2 6/1999
EP 930518 A2 7/1999
EP 0 964 134 A2 12/1999
EP 964134 A2 12/1999
EP 972909 A2 1/2000
EP 0 999 341 A2 5/2000
FR 2677134 12/1992
GB 2083321 A 3/1982
GB 2 325 949 12/1998
GB 2327695 2/1999
GB 2338253 A 12/1999
WO 80/00727 4/1980
WO 93/26115 12/1993
WO 96/00836 1/1996
WO 96/24747 8/1996
WO 97/16751 5/1997
WO 97/37103 10/1997
WO 98/20233 5/1998
WO 99/37044 7/1999
WO 99/57417 11/1999
WO 99/60247 11/1999
WO 00/04275 1/2000
WO 00/37770 6/2000
WO 01/20126 3/2001
WO 01/55555 A1 8/2001

OTHER PUBLICATIONS

Der Spek, Alex, and Aliz Thomas, "Neural-Net Identification of Flow Regime with Band Spectra of Flow-Generated Sound", SPE Reservoir Eva. & Eng.2 (6) Dec. 1999, pp. 489-498.

Sakata et al., "Performance Analysis of Long Distance Transmitting of Magnetic Signal on Cylindrical Steel Rod", IEEE Translation Journal on magnetics in Japan, vol. 8, No. 2. Feb. 1993,, pps. 102-106.

Otis Engineering, Aug. 1980, "Heavy Crude Lift System", Field Development Report, OEC 5228, Otis Corp., Dallas, Texas, 1980.

Office Action dated Sep. 22, 2005, U.S. Appl. No. 10/220,252, Vinegar.

Office Action dated Jul. 7, 2005, U.S. Appl. No. 10/220,252, Vinegar.

Office Action dated Aug. 13, 2005, U.S. Appl. No. 10/220,252, Vinegar.

Office Action dated Jan. 2, 2004, U.S. Appl. No. 10/220,252, Vinegar.

Office Action dated Apr. 8, 2005, U.S. Appl. No. 10/220,253, Hirsch.

Office Action dated Jan. 23, 2004, U.S. Appl. No. 10/220,326, Vinegar.

* cited by examiner

WIRELESS DOWNHOLE WELL INTERVAL INFLOW AND INJECTION CONTROL

This claims the benefit of 60/186,393 filed on Mar. 2, 2000.

CROSS-REFERENCES TO RELATED APPLICATIONS

This application claims the benefit of the following U.S. Provisional Applications, all of which are hereby incorporated by reference:

COMMONLY OWNED AND PREVIOUSLY FILED U.S. PROVISIONAL PATENT APPLICATIONS

| T&K # | Ser. No. | Title | Filing Date |
|---|---|---|---|
| TH 1599 | 60/177,999 | Toroidal Choke Inductor for Wireless Communication and Control | Jan. 24, 2000 |
| TH 1600 | 60/178,000 | Ferromagnetic Choke in Wellhead | Jan. 24, 2000 |
| TH 1602 | 60/178,001 | Controllable Gas-Lift Well and Valve | Jan. 24, 2000 |
| Th 1603 | 60/177,883 | Permanent, Downhole, Wireless, Two-Way Telemetry Backbone Using Redundant Repeater, Spread Spectrum Arrays | Jan. 24, 2000 |
| TH 1668 | 60/177,998 | Petroleum Well Having Downhole Sensors, Communication, and Power | Jan. 24, 2000 |
| TH 1669 | 60/177,997 | System and Method for Fluid Flow Optimization | Jan. 24, 2000 |
| TS 6185 | 60/181,322 | A Method and Apparatus for the Optimal Predistortion of an Electromagnetic Signal in a Downhole Communications System | Feb. 9, 2000 |
| TH 1599x | 60/186,376 | Toroidal Choke Inductor for Wireless Communication and Control | Mar. 2, 2000 |
| TH 1600x | 60/186,380 | Ferromagnetic Choke in Wellhead | Mar. 2, 2000 |
| TH 1601 | 60/186,505 | Reservoir Production Control from Intelligent Well Data | Mar. 2, 2000 |
| TH 1671 | 60/186,504 | Tracer Injection in a Production Well | Mar. 2, 2000 |
| TH 1672 | 60/186,379 | Oilwell Casing Electrical Power Pick-Off Points | Mar. 2, 2000 |
| TH 1673 | 60/186,394 | Controllable Production Well Packer | Mar. 2, 2000 |
| TH 1674 | 60/186,382 | Use of Downhole High Pressure Gas in a Gas Lift Well | Mar. 2, 2000 |
| TH 1675 | 60/186,503 | Wireless Smart Well Casing | Mar. 2, 2000 |
| TH 1677 | 60/186,527 | Method for Downhole Power Management Using Energization from Distributed Batteries or Capacitors with Reconfigurable Discharge | Mar. 2, 2000 |
| TH 1679 | 60/186,393 | Wireless Downhole Well Interval Inflow and Injection Control | Mar. 2, 2000 |
| TH 1681 | 60/186,394 | Focused Through-Casing Resistivity Measurement | Mar. 2, 2000 |
| TH 1704 | 60/186,531 | Downhole Rotary Hydraulic Pressure for Valve Actuation | Mar. 2, 2000 |
| TH 1705 | 60/186,377 | Wireless Downhole Measurement and Control For Optimizing Gas Lift Well and Field Performance | Mar. 2, 2000 |
| TH 1722 | 60/186,381 | Controlled Downhole Chemical Injection | Mar. 2, 2000 |
| TH 1723 | 60/186,378 | Wireless Power and Communications Cross-Bar Switch | Mar. 2, 2000 |

The current application shares some specification and figures with the following commonly owned and concurrently filed applications, all of which are hereby incorporated by reference:

COMMONLY OWNED AND CONCURRENTLY FILED U.S. PATENT APPLICATIONS

| T&K # | Ser. No. | Title | Filing Date |
|---|---|---|---|
| TH 1601 | 10/220,402 | Reservoir Production Control from Intelligent Well Data | Aug. 29, 2002 |
| TH 1671 | 10/220,251 | Tracer Injection in a Production Well | Aug. 29, 2002 |
| TH 1672 | 10/220,402 | Oil Well Casing Electrical Power Pick-Off Points | Aug. 29, 2002 |
| TH 1673 | 10/220,252 | Controllable Production Well Packer | Aug. 29, 2002 |
| TH 1674 | 10/220,249 | Use of Downhole High Pressure Gas in a Gas-Lift Well | Aug. 29, 2002 |

-continued

COMMONLY OWNED AND CONCURRENTLY FILED U.S. PATENT APPLICATIONS

| T&K # | Ser. No. | Title | Filing Date |
|---|---|---|---|
| TH 1675 | 10/220,195 | Wireless Smart Well Casing | Aug. 29, 2002 |
| TH 1677 | 10/220,253 | Method for Downhole Power Management Using Energization from Distributed Batteries or Capacitors with Reconfigurable Discharge | Aug. 29, 2002 |
| TH 1679 | 10/220,453 | Wireless Downhole Well Interval Inflow and Injection Control | Aug. 29, 2002 |
| TH 1705 | 10/220,455 | Wireless Downhole Measurement and Control For Optimizing Gas Lift Well and Field Performance | Aug. 29, 2002 |
| TH 1722 | 10/220,372 | Controlled Downhole Chemical Injection | Aug. 30, 2002 |
| TH 1723 | 10/220,652 | Wireless Power and Communications Cross-Bar Switch | Aug. 29, 2002 |

The current application shares some specification and figures with the following commonly owned and previously filed applications, all of which are hereby incorporated by reference:

COMMONLY OWNED AND PREVIOUSLY FILED U.S. PATENT APPLICATIONS

| T&K # | Ser. No. | Title | Filing Date |
|---|---|---|---|
| TH 1599US | 09/769,047 | Choke Inductor for Wireless Communication and Control | Oct. 20, 2003 |
| TH 1600US | 09/769,048 | Induction Choke for Power Distribution in Piping Structure | Jan. 24, 2001 |
| TH 1602US | 09/768,705 | Controllable Gas-Lift Well and Valve | Jan. 24, 2001 |
| TH 1603US | 09/768,655 | Permanent Downhole, Wireless, Two-Way Telemetry Backbone Using Redundant Repeater | Jan. 24, 2001 |
| TH 1668US | 09/768,046 | Petroleum Well Having Downhole Sensors, Communication, and Power | Jan. 24, 2001 |
| TH 1669US | 09/768,656 | System and Method for Fluid Flow Optimization | Jan. 24, 2001 |
| TS 6185US | 09/779,935 | A Method and Apparatus for the Optimal Predistortion of an Electro Magnetic Signal in a Downhole Communications System | Feb. 8, 2001 |

The benefit of 35 U.S.C. § 120 is claimed for all of the above referenced commonly owned applications. The applications referenced in the tables above are referred to herein as the "Related Applications."

BACKGROUND OF THE INVENTION

1. Field of the Invention

The present invention relates to a petroleum well for producing petroleum products. In one aspect, the present invention relates to systems and methods of electrically controlling downhole well interval inflow and/or injection for producing petroleum products.

2. Description of the Related Art

Attainment of high recovery efficiency from thick hydrocarbon reservoirs, requires uniform productivity from wells completed over long intervals.

In vertical wells, the open intervals typically include a number of geologic layers having a variety of petrophysical properties and initial reservoir conditions. Variations in permeability and initial reservoir pressure especially, result in uneven depletion of layers, if the layers are produced as a unit with a single draw-down pressure. As the field is produced, high permeability layers are depleted faster than tight layers, and high pressure layers may even cross-flow into lower pressure layers.

In horizontal wells, the open completion interval is usually contained in a single geologic layer. However, uneven inflow can result from a pressure drop along the well. This effect is particularly evident in long completion intervals where the reservoir pressure is nearly equal to the pressure in the well at the far end (the toe). In such a case, almost no inflow occurs at the toe. At the other end of the open interval near the vertical part of the well (the heel), the greater difference between the reservoir pressure and the pressure in the well results in higher inflow rates there. High inflow rates near the heel can lead to early gas breakthrough from gas coning down, or early water breakthrough from water coning up.

Productivity profiles of vertical wells are described by the steady state Darcy flow equation for radial flow:

$$q_R = \frac{2\pi k k_r h \Delta p}{\mu \ln(r_e / r_w)} \tag{1}$$

where $q_R$=flow rate $[1^3t^{-1}]$ k=absolute permeability $[1^2]$ $k_r$=relative permeability [unitless]

Δp=pressure draw-down=reservoir pressure-well pressure $[m1^{-1}t^{-2}]$

μ=viscosity $[m1^{-1}t^{-1}]$ $r_e$=outer radius of reservoir [1]

$r_w$=well radius [1]

h=length of open interval [1]

Each flowing fluid may be described by this equation. In most wells, we need to account for flow of the gas, oil, and water. In the initial phase of production of a field, reservoir pressure is usually large. If large draw-down pressures are applied, inflow profiles will be uniform for layers with similar permeabilities because variations in initial reservoir pressure of layers are usually smaller than the draw-down pressure. As the well is produced and layers are depleted, the reservoir pressure affects the productivity profiles to a greater extent because some layers may have a small draw-down, even if the well is produced at its lowest pressure. Variations in permeability among layers may arise from (1) differences in grain size, sorting, and packing, or (2) from interference of flowing fluids, i.e., the relative permeability. The former—grain mineral framework—is not expected to change the productivity profile very much during the life of the well because the grain framework remains unchanged, except for compaction. But compaction can equalize layer permeabilities. The effects of fluid saturation on permeability lead to poor productivity profiles because, for example, a high permeability layer is likely to have a high specific fluid saturation, which makes that layer even more productive. During the life of a well these saturation effects can lead to even poorer profiles because, for example, gas or water breakthrough into a well results in increasing breakthrough fluid saturation and even higher productivity of that fluid relative to the other layers.

Productivity profiles in horizontal wells may be affected by layering if the well intersects dipping beds or if the horizontal well is slightly inclined and crosses an impermeable bed. However, the major effect is expected to be the difference in draw-down pressure between the toe and the heel.

The problems associated with poor productivity profiles in wells with long interval completions have been addressed in a recent patent application entitled "Minipumps in a Drainhole Section of a Well", filed 15 Sept. 1999, inventors M. E. Amory, R. Daling, C. A. Glandt, R. N. Worrall, EPC Patent Application no. 99203017.1, herewith incorporated by reference. This method proposes the use of several annular pumping devices located along the open interval of the well to offset the pressure drop due to flow in the well and thereby increase the inflow at the toe of the well.

Wells may also be used for fluid injection. For example, water flooding is sometimes used to displace hydrocarbons in the formation towards producing wells. In water flooding, it is desirable to have uniform injection. Hence with fluid injection, the same issues arise with respect to ensuring uniform injection as those mentioned above for seeking uniform inflow, and for the same reasons.

Conventional packers are known such as described in U.S. Pat. Nos. 6,148,915, 6,123,148, 3,566,963 and 3,602,305.

All references cited herein are incorporated by reference to the maximum extent allowable by law. To the extent a reference may not be fully incorporated herein, it is incorporated by reference for background purposes, and indicative of the knowledge of one of ordinary skill in the art.

BRIEF SUMMARY OF THE INVENTION

The problems and needs outlined above are largely solved and met by the present invention. In accordance with one aspect of the present invention, a petroleum well for producing petroleum products, is provided. The petroleum well comprises a well casing, a production tubing, a source of time-varying current, and a downhole controllable well section. The well casing extends within a wellbore of the well, and the production tubing extends within the casing. The source of time-varying current is at the surface, and electrically connected to the tubing and/or the casing, such that the tubing and/or the casing acts as an electrical conductor for transmitting time-varying electrical current from the surface to a downhole location. The downhole controllable well section comprises a communications and control module, a sensor, an electrically controllable valve, and an induction choke. The communications and control module is electrically connected to the tubing and/or the casing. The sensor and the electrically controllable valve are electrically connected to the communications and control module. The electrically controllable valve is adapted to regulate flow between an exterior of the tubing and an interior of the tubing. The induction choke is located about a portion of the tubing and/or the casing. The induction choke is adapted to route part of the current through the communications and control module by creating a voltage potential within the tubing and/or the casing between one side of the induction choke and another side of the induction choke. The communications and control module is electrically connected across this voltage potential. The downhole controllable well section may further comprise a flow inhibitor located within the casing and about another portion of the tubing such that fluid flow within the casing from one side of the flow inhibitor to another side of the flow inhibitor is hindered by the flow inhibitor. In an embodiment with multiple well sections, a flow inhibitor may be used to define a boundary between the well sections. The sensor may be a fluid flow sensor, a fluid pressure sensor, a fluid density sensor, or an acoustic waveform transducer.

In accordance with another aspect of the present invention, a method of producing petroleum from a petroleum well is provided. The method comprises the following steps, the order of which may vary: (i) providing a plurality of downhole controllable well sections of the well for. at least one petroleum production zone, each of the well sections comprising a communications and control module, a flow sensor, an electrically controllable valve, and a flow inhibitor, the flow inhibitor being located within a well casing and about a portion of a production tubing of the well, the communications and control module being electrically connected to the tubing and/or the casing, and the electrically controllable valve and the flow sensor being electrically connected to the communications and control module; (ii) hindering fluid flow between the well sections within the casing with the flow inhibitor; (iii) measuring fluid flow between the at least one petroleum production zone and an interior of the tubing at each of the well sections with its respective flow sensor; (iv) regulating fluid flow between the at least one petroleum production zone and the interior of the tubing at each of the well sections with its respective electrically controllable valve, based on the fluid flow measurements; and (v) producing petroleum products from the well via the tubing.

The method may further comprise the following steps, the order of which may vary: (vi) inputting a time-varying current into the tubing and/or the casing from a current source at the surface; (vii) impeding the current with an induction choke located about the tubing and/or the casing; (viii) creating a voltage potential between one side of the induction choke and another side of the induction choke within the tubing and/or the casing; (ix) routing the current through at least one of the communications and control modules at the voltage potential using the induction choke; and (x) powering at least one of the communications and control modules using the voltage potential and the current from the tubing and/or the casing. Also, the method may further comprise the following steps, the order of which may vary: (xi) transmitting the fluid flow measurements to a computer system at the surface using the communications and control module via the tubing and/or the casing; (xii) calculating a pressure drop along the well sections, with the computer system, and using the fluid flow measurements; (xiii) determining if adjustments are needed for the electrically controllable valves of the well sections; (xiv) if valve adjustments are needed, sending command signals to the communications and control modules of the well sections needing valve adjustment; and (xv) also if valve adjustments are needed, adjusting a position of the electrically controllable valve via the communications and control module for each of the well sections needing valve adjustment.

In accordance with yet another aspect of the present invention, a method of controllably injecting fluid into a formation with a well is provided. The method comprises the following steps, the order of which may vary: (i) providing a plurality of controllable well sections of the well for the formation, each of the well sections comprising a communications and control module, a flow sensor, and an electrically controllable valve, and a flow inhibitor, the communications and control module being electrically connected to the tubing and/or the casing, the electrically controllable valve and the flow sensor being electrically connected to the communications and control module, and the flow inhibitor being located within a well casing and about a portion of a tubing string of the well; (ii) hindering fluid flow between the well sections within the casing with the flow inhibitors; (iii) measuring fluid flow from an interior of the tubing into the formation at each of the well sections with its respective flow sensor; (iv) regulating fluid flow from the tubing interior into the formation at each of the well sections with its respective electrically controllable valve, based on the fluid flow measurements; and (v) controllably injecting fluid into the formation with the well.

The method may further comprise the following steps, the order of which may vary: (vi) inputting a time-varying current into the tubing and/or the casing from a current source at the surface; (vii) impeding the current with an induction choke located about the tubing and/or the casing; (viii) creating a voltage potential between one side of the induction choke and another side of the induction choke within the tubing and/or the casing; (ix) routing the current through at least one of the communications and control modules at the voltage potential using the induction choke; and (x) powering the at least one of the communications and control modules using the voltage potential and the current from the tubing and/or the casing. Also, the method may further comprise the following steps, the order of which may vary: (xi) transmitting the fluid flow measurements to a computer system at the surface using the communications and control module via the tubing and/or the casing; (xii) calculating a pressure drop along the well sections, with the computer system, using the fluid flow measurements; (xiii) determining if adjustments are needed for the electrically controllable valves of the well sections; (xiv) if valve adjustments are needed, sending command signals to the communications and control modules of the well sections needing valve adjustment; and (xv) also if valve adjustments are needed, adjusting a position of the electrically controllable valve via the communications and control module for each of the well sections needing valve adjustment.

The Related Applications describe ways to deliver electrical power to downhole devices, and to provide bi-directional communications between the surface and each downhole device individually. The downhole devices may contain sensors or transducers to measure downhole conditions, such as pressure, flow rate, liquid density, or acoustic waveforms. Such measurements can be transmitted to the surface and made available in near-real-time. The downhole devices may also comprise electrically controllable valves, pressure regulators, or other mechanical control devices that can be operated or whose set-points may be changed in real time by commands sent from the surface to each individual device downhole. Downhole devices to measure and control inflow or injection over long interval completions are placed within well sections. The measured flow rates are used to control accompanying devices, which are used to regulate inflow from or injection into subsections of the completion.

BRIEF DESCRIPTION OF THE DRAWINGS

Other objects and advantages of the invention will become apparent upon reading the following detailed description and upon referencing the accompanying drawings, in which.

DETAILED DESCRIPTION OF THE INVENTION

Figure 1A:
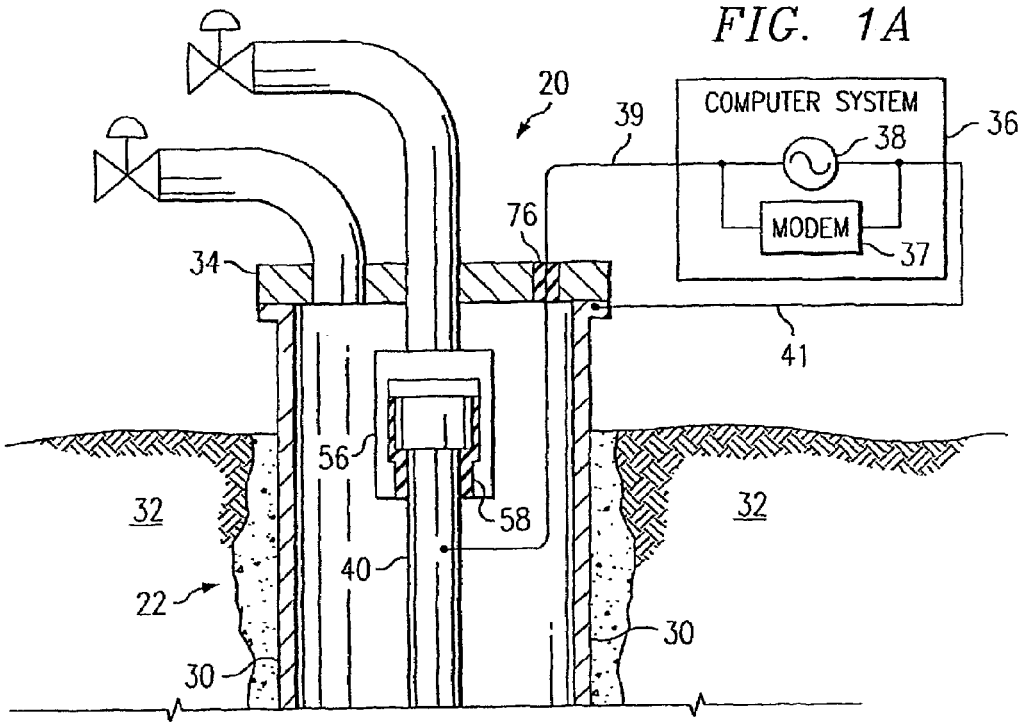
FIG. 1A is schematic of an upper portion of a petroleum well in accordance with a preferred embodiment of the present invention.

Referring now to the drawings, wherein like reference numbers are used herein to designate like elements throughout the various views, a preferred embodiment of the present invention is illustrated and further described, and other possible embodiments of the present invention are described. The figures are not necessarily drawn to scale, and in some instances the drawings have been exaggerated and/or simplified in places for illustrative purposes only. One of ordinary skill in the art will appreciate the many possible applications and variations of the present invention based on the following examples of possible embodiments of the present invention, as well as based on those embodiments illustrated and discussed in the Related Applications, which are incorporated by reference herein to the maximum extent allowed by law.

As used in the present application, a "piping structure" can be one single pipe, a tubing string, a well casing, a pumping rod, a series of interconnected pipes, rods, rails, trusses, lattices, supports, a branch or lateral extension of a well, a network of interconnected pipes, or other similar structures known to one of ordinary skill in the art. A preferred embodiment makes use of the invention in the context of a petroleum well where the piping structure comprises tubular, metallic, electrically-conductive pipe or tubing strings, but the invention is not so limited. For the present invention, at least a portion of the piping structure needs to be electrically conductive, such electrically conductive portion may be the entire piping structure (e.g., steel pipes, copper pipes) or a longitudinal extending electrically conductive portion combined with a longitudinally extending non-conductive portion. In other words, an electrically conductive piping structure is one that provides an electrical conducting path from a first portion where a power source is electrically connected to a second portion where a device and/or electrical return is electrically connected. The piping structure will typically be conventional round metal tubing, but the cross-section geometry of the piping structure, or any portion thereof, can vary in shape (e.g., round, rectangular, square, oval) and size (e.g., length, diameter, wall thickness)

along any portion of the piping structure. Hence, a piping structure must have an electrically conductive portion extending from a first portion of the piping structure to a second portion of the piping structure, wherein the first portion is distally spaced from the second portion along the piping structure.

Also note that the term "modem" is used herein to generically refer to any communications device for transmitting and/or receiving electrical communication signals via an electrical conductor (e.g., metal). Hence, the term "modem" as used herein is not limited to the acronym for a modulator (device that converts a voice or data signal into a form that can be transmitted)/demodulator (a device that recovers an original signal after it has modulated a high frequency carrier). Also, the term "modem" as used herein is not limited to conventional computer modems that convert digital signals to analog signals and vice versa (e.g., to send digital data signals over the analog Public Switched Telephone Network). For example, if a sensor outputs measurements in an analog format, then such measurements may only need to be modulated (e.g., spread spectrum modulation) and transmitted—hence no analog/digital conversion needed. As another example, a relay/slave modem or communication device may only need to identify, filter, amplify, and/or retransmit a signal received.

The term "valve" as used herein generally refers to any device that functions to regulate the flow of a fluid. Examples of valves include, but are not limited to, bellows-type gas-lift valves and controllable gas-lift valves, each of which may be used to regulate the flow of lift gas into a tubing string of a well. The internal and/or external workings of valves can vary greatly, and in the present application, it is not intended to limit the valves described to any particular configuration, so long as the valve functions to regulate flow. Some of the various types of flow regulating mechanisms include, but are not limited to, ball valve configurations, needle valve configurations, gate valve configurations, and cage valve configurations. The methods of installation for valves discussed in the present application can vary widely.

The term "electrically controllable valve" as used herein generally refers to a "valve" (as just described) that can be opened, closed, adjusted, altered, or throttled continuously in response to an electrical control signal (e.g., signal from a surface computer or from a downhole electronic controller module). The mechanism that actually moves the valve position can comprise, but is not limited to: an electric motor; an electric servo; an electric solenoid; an electric switch; a hydraulic actuator controlled by at least one electrical servo, electrical motor, electrical switch, electric solenoid, or combinations thereof; a pneumatic actuator controlled by at least one electrical servo, electrical motor, electrical switch, electric solenoid, or combinations thereof; or a spring biased device in combination with at least one electrical servo, electrical motor, electrical switch, electric solenoid, or combinations thereof. An "electrically controllable valve" may or may not include a position feedback sensor for providing a feedback signal corresponding to the actual position of the valve.

The term "sensor" as used herein refers to any device that detects, determines, monitors, records, or otherwise senses the absolute value of or a change in a physical quantity. A sensor as described herein can be used to measure physical quantities including, but not limited to: temperature, pressure (both absolute and differential), flow rate, seismic data, acoustic data, pH level, salinity levels, valve positions, or almost any other physical data.

The phrase "at the surface" as used herein refers to a location that is above about fifty feet deep within the Earth. In other words, the phrase "at the surface" does not necessarily mean sitting on the ground at ground level, but is used more broadly herein to refer to a location that is often easily or conveniently accessible at a wellhead where people may be working. For example, "at the surface" can be on a table in a work shed that is located on the ground at the well platform, it can be on an ocean floor or a lake floor, it can be on a deep-sea oil rig platform, or it can be on the 100th floor of a building. Also, the term "surface" may be used herein as an adjective to designate a location of a component or region that is located "at the surface." For example, as used herein, a "surface" computer would be a computer located "at the surface."

The term "downhole" as used herein refers to a location or position below about fifty feet deep within the Earth. In other words, "downhole" is used broadly herein to refer to a location that is often not easily or conveniently accessible from a wellhead where people may be working. For example in a petroleum well, a "downhole" location is often at or proximate to a subsurface petroleum production zone, irrespective of whether the production zone is accessed vertically, horizontally, or any other angle therebetween. Also, the term "downhole" is used herein as an adjective describing the location of a component or region. For example, a "downhole" device in a well would be a device located "downhole," as opposed to being located "at the surface."

Similarly, in accordance with conventional terminology of oilfield practice, the descriptors "upper," "lower," "uphole," and "downhole" are relative and refer to distance along hole depth from the surface, which in deviated or horizontal wells may or may not accord with vertical elevation measured with respect to a survey datum.

As used in the present application, "wireless" means the absence of a conventional, insulated wire conductor e.g. extending from a downhole device to the surface. Using the tubing and/or casing as a conductor is considered "wireless."

Conventional horizontal wells are typically completed with perforated casings or screened liners, some of which may be several thousand feet long and four to six inches in diameter. For wells that are prolific producers, the horizontal liner conducts all of the flow to a vertical section. Production tubing and a packer may be placed within a vertical well casing of the vertical section, where gas lift or other artificial lift may be employed. However in such conventional horizontal wells, the inflow rates of fluids from a production zone at various places along the extent of the horizontal well can vary greatly as the zone is depleted. Such variations can lead to an increased pressure drop along the horizontal well and the consequent excessive inflow rate near the heel of the well relative to the toe, which is typically not desirable. The present invention presents a solution to such problems, as well as others, by providing a well with controllable well sections.

FIG. 1A is schematic of an upper portion of a petroleum well 20 in accordance with a preferred embodiment of the present invention. A well casing 30 and the tubing string 40 act as electrical conductors for the system. An insulating tubing joint 56 is incorporated at the wellhead to electrically insulate the tubing 40 from casing 30. Thus, the insulators 58 of the joint 56 prevent an electrical short circuit between lower sections of the tubing 40 and casing 30 at the hanger 34. A surface computer system 36 comprising a master modem 37 and a source of time-varying current 38 is electrically connected to the tubing string 40 below the hanger 34 by a first source terminal 39. The first source terminal 39 is insulated from the hanger 34 where it passes through it. A second source terminal 41 is electrically connected to the well casing 30, either directly (as in FIG. 1A) or via the hanger 34 (arrangement not shown).

The time-varying current source 38 provides the time-varying electrical current, which carries power and communication signals downhole. The time-varying electrical current is preferably alternating current (AC), but it can also be a varying direct current (DC). The communication signals can be generated by the master modem 37 and embedded within the current produced by the source 38. Preferably, the communication signal is a spread spectrum signal, but other forms of modulation can be used in alternative.

Figure 1B:
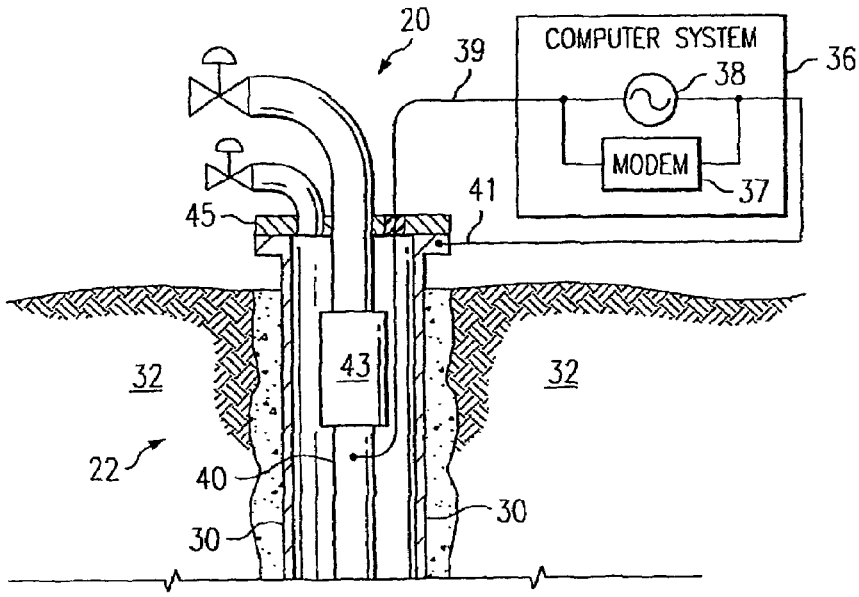
FIG. 1B is schematic of an upper portion of a petroleum well in accordance with another preferred embodiment of the present invention.

As shown in FIG. 1B, in alternative to or in addition to the insulated hanger 34, an upper induction choke 43 can be placed about the tubing 40 above the electrical connection location for the first source terminal 39 to the tubing. The upper induction choke 43 comprises a ferromagnetic material and is located generally concentrically about the tubing 40. The upper induction choke 43 functions based on its size, geometry, spatial relationship to the tubing 40, and magnetic properties. When time-varying current is imparted into the tubing 40 below the upper choke 43, the upper choke 43 acts as an inductor inhibiting the flow of the current between the tubing 40 below the upper choke 43 and the tubing 40 above the upper choke 43 due to the magnetic flux created within the upper choke 43 by the current. Thus, most of the current is routed down the tubing 40 (i.e., downhole), rather than shorting across the hanger 45 to the casing 30.

Figure 2:
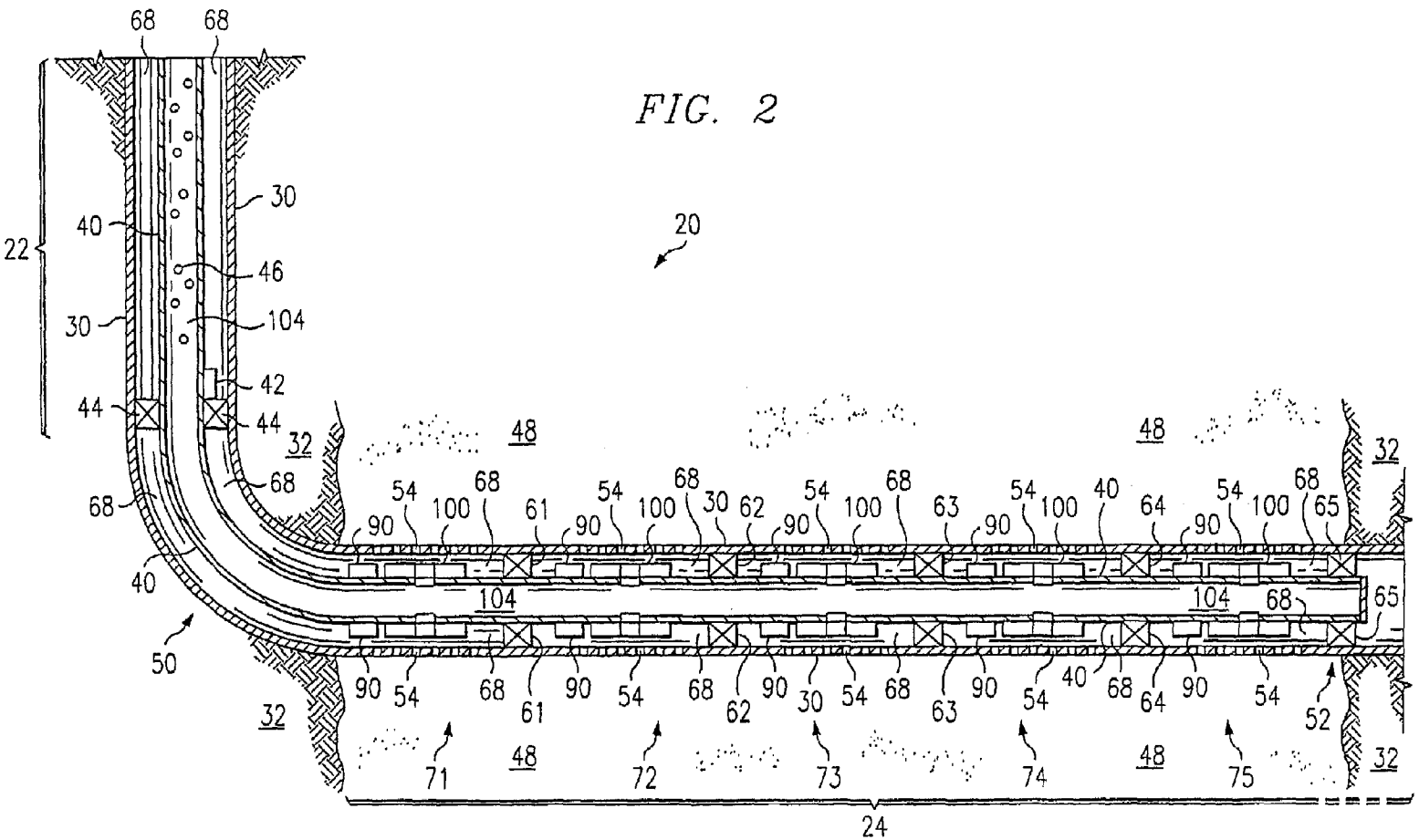
FIG. 2 is a schematic of a downhole portion of a petroleum production well in accordance with a preferred embodiment of the present invention.

FIG. 2 is schematic of a downhole portion of a petroleum production well 20 in accordance with a preferred embodiment of the present invention. The well 20 has a vertical section 22 and a horizontal section 24. The well has a well casing 30 extending within a wellbore and through a formation 32, and a production tubing 40 extends within the well casing. Hence, the well 20 shown in FIG. 2 is similar to a conventional well in construction, but with the incorporation of the present invention.

The vertical section 22 in this embodiment incorporates a packer 44 which is furnished with an electrically insulating sleeve 76 such that the tubing 40 is electrically insulated from casing 30. The vertical section 22 is also furnished with a gas-lift valve 42 to provide artificial lift for fluids within the tubing using gas bubbles 46. However, in alternative, other ways of providing artificial lift may be incorporated to form other possible embodiments (e.g., rod pumping). Also, the vertical portion 22 can further vary to form many other possible embodiments. For example in an enhanced form, the vertical portion 22 may incorporate one or more electrically controllable gas-lift valves, one or more induction chokes, and/or one or more controllable packers comprising electrically controllable packer valves, as described in the Related Applications.

The horizontal section 24 of the well 20 extends through a petroleum production zone 48 (e.g., oil zone) of the formation 32. The location where the vertical section 22 and the horizontal section 24 meet is referred to as the heal 50, and the distal end of the horizontal section is referred to as the toe 52. At various locations along the horizontal section 24, the casing 30 has perforated sections 54 that allow fluids to pass from the production zone 48 into the casing 30. Numerous flow inhibitors 61–65 are placed along the horizontal section 24 in the annular space 68 between the casing 30 and the tubing 40. The purpose of these flow inhibitors 61–65 is to hinder or prevent fluid flow along the annulus 68 within the casing 30, and to separate or form a series of controllable well sections 71–75. In the embodiment shown in FIG. 2, the flow inhibitors 61–65 are conventional packers with electrically insulating sleeves to maintain electrical isolation between tubing 104 and casing 30 (functionally equivalent to packer 44 with sleeve 76), which themselves are known in the art. However, any of the flow inhibitors 61–65 can be provided by any other way that makes the cross-sectional area of the annular space 68 (between the casing 30 and the tubing 40) small compared to the internal cross-sectional area of the tubing 40, while maintaining electrical isolation between tubing and casing. In other words, the flow inhibitors 61–65 do not necessarily need to form fluid-tight seals between the well sections 71–75, as conventional packers typically do. Thus, for example, any of the flow inhibitors 61–65 may be (but is not limited to being): a conventional packer; a controllable packer comprising an electrically controllable packer valve, as described in the Related Applications; a close-fitting tubular section; an enlarged portion of tubing; a collar about the tubing; or an inflatable collar about the tubing. In an enhanced form, a controllable packer as a flow inhibitor can provide variable control over the fluid communication among well sections-such controllable packers are further described in the Related Applications.

Figure 3:
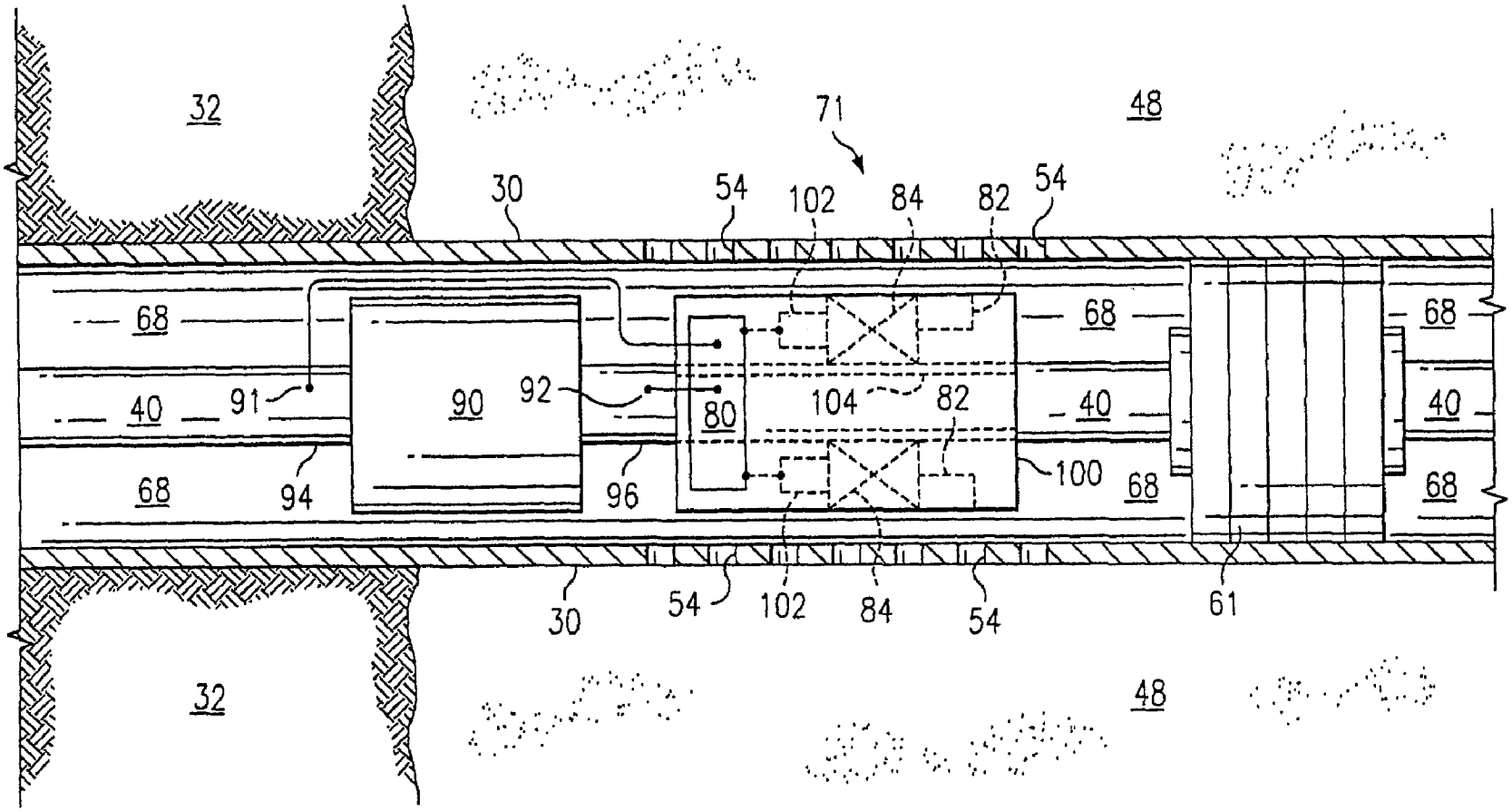
FIG. 3 is an enlarged view of a portion of FIG. 2 showing a well section of the petroleum production well.

Referring to FIGS. 2 and 3, each controllable well section 71–75 comprises a communications and control module 80, a sensor 82, and an electrically controllable valve 84. In a preferred embodiment, each well section 71–75 further comprises a ferromagnetic induction choke 90. But in alternative embodiments, the number of downhole induction chokes 90 may vary. For example, there may be one downhole induction choke 90 for two or more well sections 71–75, and hence some of the well sections would not comprise an induction choke.

Power for the electrical components of the well sections 71–75 is provided from the surface using the tubing 40 and casing 30 as electrical conductors. Hence, in a preferred embodiment, the tubing 40 acts as a piping structure and the casing 30 acts as an electrical return to form an electrical circuit in the well 20. Also, the tubing 40 and casing 30 are used as electrical conductors for communications signals between the surface (e.g., a surface computer) and the downhole electrical devices within the controllable well sections 71–75.

In the embodiment shown in FIGS. 2 and 3, there is a downhole induction choke 90 for each controllable well section 71–75. The downhole induction chokes 90 comprise a ferromagnetic material and are unpowered. The downhole chokes 90 are located about the tubing 40, and each choke acts as a large inductor to AC in the well circuit formed by the tubing 40 and casing 30. The downhole chokes 90 function based on their size (mass), geometry, and magnetic properties, as described above regarding the upper choke. The material composition of the chokes 43, 90 may vary, as long as they exhibit the requisite magnetic properties needed to act as an inductor to the time-varying current, which will depend (in part) on the size of the current.

FIG. 3 is an enlarged view of a controllable well section 71 from FIG. 2. Focusing on the well section 71 of FIG. 3 as an example, the communications and control module 80 is electrically connected to the tubing 40 for power and/or communications. A first device terminal 91 of the communications and control module 80 is electrically connected to the tubing 40 on a source-side 94 of the downhole induction choke 90. And, a second device terminal 92 of the communications and control module 80 is electrically connected to the tubing 40 on an electrical-return-side 96 of the downhole induction choke 90. When AC is imparted into the tubing 40 at the surface, it travels freely downhole along the tubing until it encounters the downhole induction choke 90, which impedes the current flow through the tubing at the choke. This creates a voltage potential between the tubing 40 on the source-side 94 of the downhole choke 90 and the tubing on the electrical-return-side 96 of the choke. Because the communications and control module 80 is electrically connected across the voltage potential formed by the downhole choke 90 when AC flows in the tubing 40, the downhole induction choke 90 effectively routes most of the current through the communications and control module 80. The voltage potential also forms between the source-side 94 of the tubing 40 and the casing 30 because the casing acts as an electrical return for the well circuit. Thus in alternative, the communications and control module 80 can be electrically connected across the voltage potential between the tubing 40 and the casing 30. If in an enhanced form one or more of the flow inhibitors 61–65 is a packer comprising an electrically powered device (e.g., sensor, electrically controllable packer valve), the electrically powered device of the packer will likely also be electrically connected across the voltage potential created by the downhole choke 90, either directly or via a nearby communications and control module 80.

Referring again to FIG. 2, the packer 65 at the toe 52 provides an electrical connection between the tubing 40 and the casing 30, and the casing 30 is electrically connected to the surface computer system (not shown) to complete the electrical circuit formed by the well 20. Because in this embodiment it is not desirable to have the tubing 40 electrically shorted to casing 30 between the surface and the toe 52, it is necessary to electrically insulate part of the packers 44, 61, 62, 63, 64 between the surface and the toe so that they do not act as a shorts between the tubing 40 and the casing 30. Such electrical insulation of a flow inhibitor may be achieved in various ways apparent to one of ordinary skill in the art, including (but not limited to): an insulating sleeve about the tubing at the flow inhibitor location or about the flow inhibitor; an insulating coating on the tubing at the flow inhibitor location or on the radial extent of the flow inhibitor; a rubber or urethane portion at the radial extent of packer slips; forming packer slips from non-electrically-conductive materials; other known insulating means; or any combination thereof. In FIG. 3, the intermediate packers 44, 61, 62, 63, 64 have an insulator at the radial extent of each packer where the packer contacts the casing 30 (e.g., the slips).

Other alternative ways to develop an electrical circuit using a piping structure of a well and at least one induction choke are described in the Related Applications, many of which can be applied in conjunction with the present invention to provide power and/or communications to the electrically powered downhole devices and to form other embodiments of the present invention.

Referring again to FIG. 3, preferably, a tubing pod 100 holds or contains the communications and control module 80, sensors 82, and electrically controllable valves 84 together as one module for ease of handling and installation, as well as to protect these components from the surrounding environment. However, in other embodiments of the present invention, the components of the tubing pod 100 can be separate (i.e., no tubing pod) or combined in other combinations. Also, there may be multiple tubing pods per well section, which may be powered using one or more induction chokes for creating voltage potential. Furthermore, multiple tubing pods may share a single communications and control module. The various combinations possible are vast, but the core of a controllable well section is having at least one communications and control module, at least one sensor, and at least one electrically controllable valve therein. The contents of a communications and control module may be as simple as a wire connector terminal for distributing electrical connections from the tubing 40, or it may be very complex comprising, for example (but not limited to), a modem, a rechargeable battery, a power transformer, a microprocessor, a memory storage device, a data acquisition card, and a motion control card.

The tubing pod 100 shown in FIG. 3 has two sensors 82 and two electrically controllable valves 84. Each valve 84 has an electric motor 102 coupled thereto, via a set of gears, for opening, closing, adjusting, or continuously throttling the valve position in response to command signals from the communications and control module 80. The electrically controllable valves 84 regulate fluid flow between an exterior (e.g., annulus 68, production zone 48) of the tubing 40 and an interior 104 of the tubing 40. In other embodiments, the controlled-opening orifice of the tubing created by the valve 84 may be controlled by the sensor 82, and may be actuated by the natural hydraulic power in the flowing well, by stored electrical power, or other ways. The orifice of the valve 84 may comprise a standard ball valve, a rotating sleeve, a linear sleeve valve, or any other device suitable to regulate flow. It may never be necessary to effect a complete shut-off or closing of the valve 84, but if needed, that type of valve may be used. Hence during petroleum production, fluids (e.g., oil) from the production zone 48 flow into the casing 30 via the perforated casing sections 54, and then into the tubing 40 via the electrically controllable valves 84. Each electrically controllable valve 84 can be independently adjusted. Thus, for example, differential pressures can be created between separate controllable well sections 71–75 along the producing interval to prevent excessive inflow rates near the heel 50 of the well 20 relative to the toe 52.

The sensors 82 in FIG. 3 are fluid flow sensors adapted to measure the fluid flow between the production zone 48 and the tubing interior 104. Flow sensors may be used that detect the fluid velocity quantitatively or only the relative rates compared to the sensors in the other well sections. Such sensors may utilize sonic, thermal conduction, or other principles known to those skilled in the art. Furthermore, in other embodiments, the sensor or sensors 82 in a controllable well section 71–75 may be adapted to measure other physical qualities, including (but not limited to): absolute pressure, differential pressure, fluid density, fluid viscosity, acoustic transmission or reflection properties, temperature, or chemical make-up. The fluid flow measurements from the sensors 82 are provided to the communications and control module 80, which further handles the measurements.

Preferably the communications and control module 80 comprises a modem and transmits the flow measurements to the surface computer system within an AC signal (e.g., spread spectrum modulation) via the tubing 40 and casing 30. Then, the surface computer system uses the measurements from one, some, or all of the sensors 82 in the well 20 to calculate the pressure drop along the horizontal well section 24, as further described below. Based on the downhole sensor measurements, it is determined whether adjustments to the downhole valves 84 are needed. If an electrically controllable downhole valve 84 needs adjustment, the surface computer system transmits control commands to the relevant communications and control module 80 using the master modem and via the tubing 40 and casing 30. The communications and control module 80 receives the control commands from the surface computer system and controls the adjustment of the respective valve(s) 84 accordingly. In another embodiment, one or more of the communications and control modules 80 may comprise an internal logic circuit and/or a microprocessor to locally (downhole) calculate pressure differential based on the sensor measurements, and locally generate valve control command signals for adjusting the valves 84.

During operation, pressure draw-down in the well 20 may be accomplished by the surface tubing valve/orifice 84 in a flowing well, or by artificial lift at the bottom of the vertical section 22. For example, such artificial lift may be provided by gas lift, rod pumping, submersible pumps, or other standard oil field methods.

Effective use of a flow measurement and regulation system provided by controllable well sections 71–75 depends on developing a control strategy that relates measured flow values to downhole conditions, and that develops an objective function for controlling the settings of the valves 84 (the flow regulators).

In horizontal well sections, the effect of differences in draw-down pressure on productivity can be demonstrated by calculating the pressure drop along the horizontal section 24 resulting from a distributed inflow of fluid from the formation.

Example Horizontal Well Analysis:

L=length of entire open interval [ft]

N=number of monitor points (subsections)

ΔL=L/N=spacing of monitors [ft]

n=index of subsection (from toe to heel)

$Q_N$=total flow rate from well [b/d]

$p_N$=total pressure drop over open interval [psi]

$p_H$=head loss from flow in well [(psi/ft)/(b/d)]

$dq_f$=specific inflow rate with uniform profile from formation into well [b/d/ft]

$\Delta q_f$=inflow rate from formation into a subsection of the well [b/d]

$\Delta q_n$=flow rate in the well at subsection (n) [b/d]

$\Delta p_n$=pressure drop in subsection n=$p_H(\Delta L)(\Delta q_n)$ [psi]

Assuming the well is subdivided into N well sections, from upstream (toe to heel), $$n=1, 2, 3, 4, \ldots N \tag{2}$$

With uniform inflow, $$\Delta q_f=\Delta L(Q_N/L)[1, 1, 1, 1, \ldots 1] \tag{3}$$

The flow rate in the well cumulates as inflow occurs from the toe to the heel, $$\Delta q_n=\Delta L(Q_N/L)[1, 2, 3, 4, \ldots N] \tag{4}$$

The pressure drop in each subsection is assumed proportional to the flow rate, therefore, $$\Delta p_n=\Delta L(\Delta q_n)(p_H)[1, 2, 3, 4, \ldots N] \tag{5}$$

Adding the pressure drops in each subsection, the total pressure drop in the well from the toe to the successively downstream subsections is $$p_n=\Sigma_1^n \Delta p_n \tag{6}$$

$$p_n=\Sigma_1^n \Delta L(\Delta q_n)(p_H)(n)(n+1)/2) \tag{7}$$

$$p_n=\Delta L(\Delta q_n)(p_H)\ [1, 3, 6, 10, 15, \ldots N(N+1)/2] \tag{8}$$

Assumptions

| | |
|---|---|
| length of entire open interval = | 2500 ft |
| spacing of monitors = | 100 ft |
| total flow rate from well = | 2500 b/d |
| specific head loss in well = | $10^{-4}$ psi/b/d/ft |

Case 1: Inflow at Toe of Well, No Inflow Along Interval

For a well in which all 2500 barrels are flowing through 2500 feet of the well the pressure drop would be:

$$(Q_N)(L)(p_H)=(2500)(2500)(10^{-4})=625 \text{ psi} \tag{9}$$

Case 2: Uniform Inflow

For a well producing uniformly along 25 subdivisions (controllable well solution), the total pressure drop in its open interval, as calculated by Equation (8) is:

$$(\Delta q_n)(\Delta L)(p_H)[N(N+1)/2]=(100)(100)(10^{-4})(25)(26)/2=325 \text{ psi.} \tag{10}$$

Case 3: Inflow Dependent Upon Reservoir Pressure

The inflow rate into the well is proportional to the difference between the reservoir pressure and the pressure in the well. Because the pressures in the well along the open interval depend on flow rate, the inflow profile must be obtained by an iterative calculation. We define the reservoir pressure ($p_{res}$) as some pressure ($p_o$) above the highest pressure in the well, that is, the pressure at the toe.

$$p_{res}=p_o+p_{toe} \tag{11}$$

The pressure difference between the reservoir pressure and the pressure in the well at locations downstream from the toe is:

$$\Delta p_i=(p_o+p_{toe})-(p_{toe}-p_n)=p_o+p_n \tag{12}$$

$$\Delta p_i = p_o + \sum_1^i \Delta L(\Delta q_n)(p_H)(n)(n+1)/2 \tag{13}$$

In the first iteration, the cumulative flow and cumulative pressure drop along the tubing may be calculated by summing the inflow differential pressures ($p_o+p_n$) and normalizing the subsection differential pressures with that sum:

$$\text{Sum } \Delta p_i=\Sigma_1^N \Delta p_i \tag{14}$$

$$\text{Normalized } \Delta p_i = Pi = \frac{\Delta p_i}{\text{Sum } \Delta p_i = \sum_1^N \Delta p_i} \tag{15}$$

The inflow rate of each subsection is proportional to this normalized differential pressure, therefore, the inflow rate of each subsection is:

$$q_i=P_i(Q_N)/(\Delta L) \tag{16}$$

The cumulative flow occurring in the well is:

$$Q_i=\Sigma q_i(\Delta L), \tag{17}$$

and the cumulative pressure drop in the well from the toe to the heel is:

$$p_{n1}=\Sigma\Sigma q_i(\Delta L)(p_H) \tag{18}$$

A second iteration is made by substituting these values for the pressure drops into Equation (12). Convergence is rapid—in this case only a few iterations are needed. These can be carried out by substituting successive values of $p_{n1,2,3 \ldots}$ in Equation (15).

Figure 4:
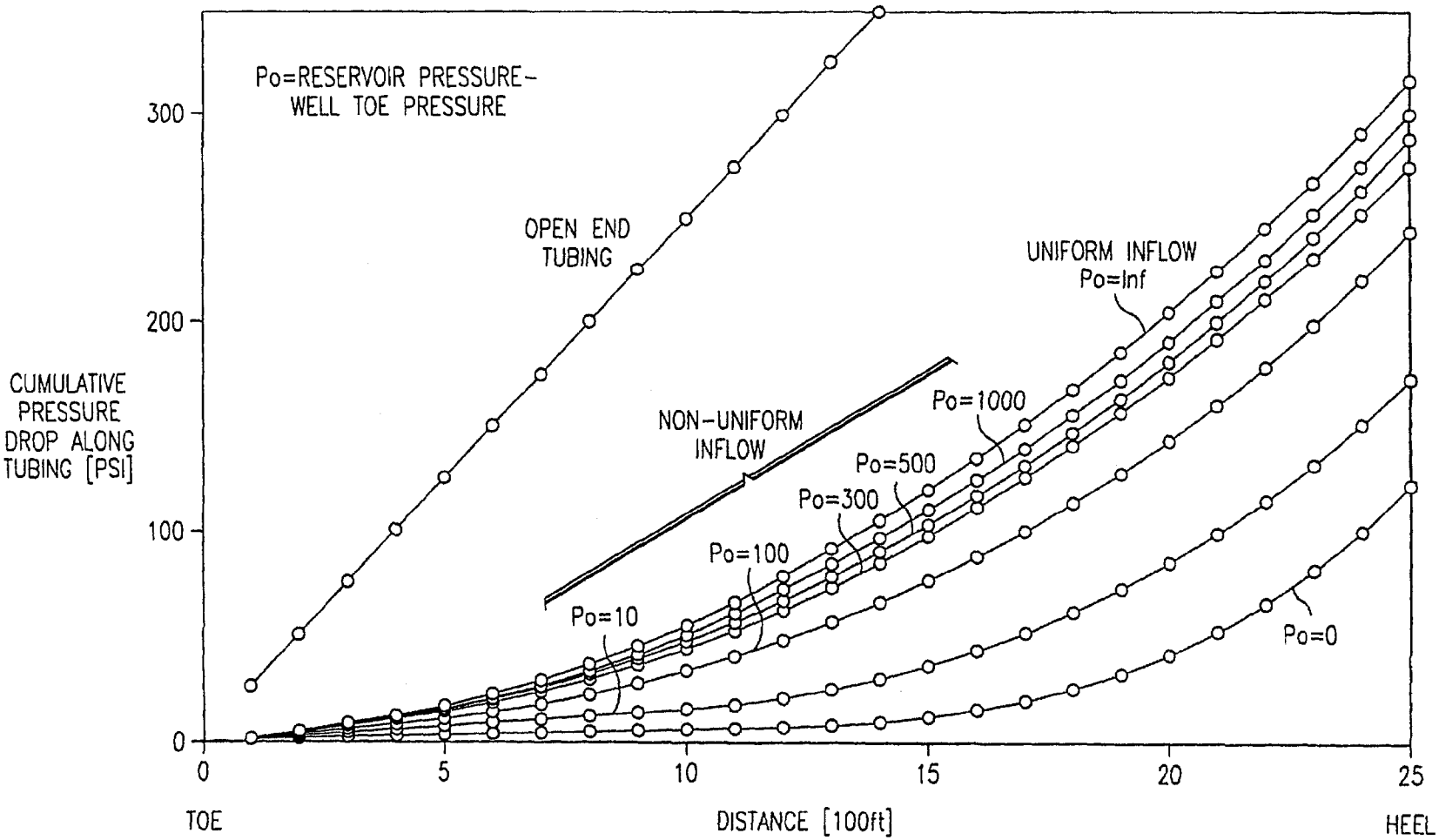
FIG. 4 graphs cumulative pressure drop along production tubing as a function of distance along the tubing for a range of differences between reservoir pressure and well toe pressure.

FIG. 4 presents the results of these pressure drop calculations for several inflow conditions. When all of the flow enters the well at the toe, (Case 1—Open End Tubing), the cumulative pressure drop along the tubing is large since each section of the pipe experiences the maximum pressure drop. When flow is uniform along the length of the horizontal well section, (Case 2—Uniform Inflow), smaller pressure drops occur near the toe where flow rates in the well are low. For the same total flow rate of 2500 b/d, the uniform inflow case results in only about half the total pressure drop (325 psi) compared to Case 1, where the total pressure drop is 625 psi. When inflow is dependent on the reservoir pressure (Case 3—Non-Uniform Inflow), even lower pressure drops occur. If the reservoir pressure only slightly exceeds the well toe pressure, and the pressure drop in the well is large by comparison, then most of the inflow occurs near the heel. The lower limit occurs when the reservoir pressure equals the well toe pressure (i.e., $p_o=0$) In that case the total pressure drop is 125 psi. The upper limit, when reservoir pressure becomes large ($p_o=\infty$), results in uniform inflow.

Figure 5:
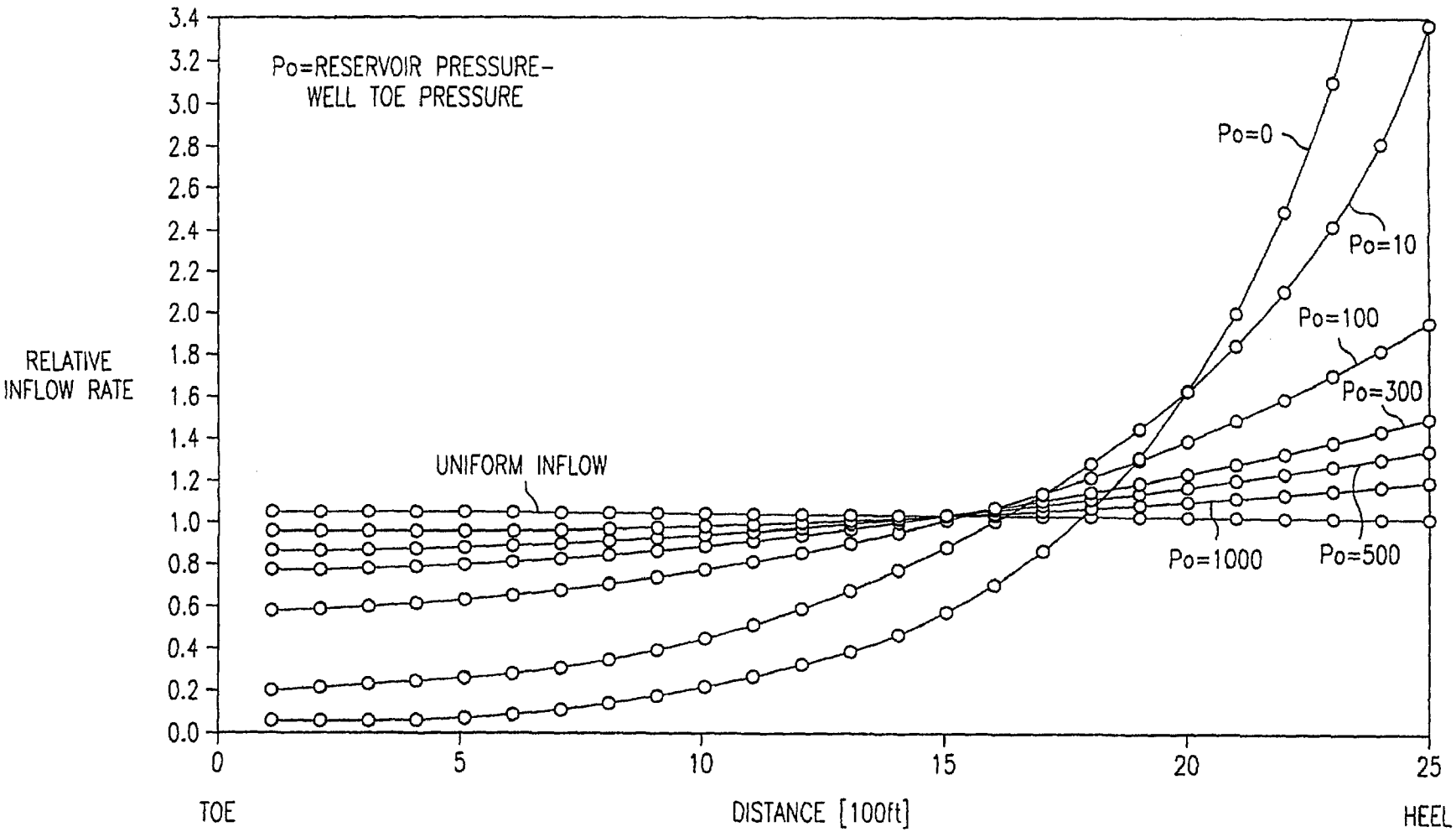
FIG. 5 graphs relative inflow rate as a function of distance along the tubing for a range of differences between the reservoir pressure and the pressure at the toe of the well.

FIG. 5 shows the calculated flow rates that result from various reservoir inflow conditions. The flow rates that occur along the horizontal well section under the conditions given above may be normalized with respect to the flow rates in a well with uniform inflow. These results demonstrate the high rates that can occur near the heel of a horizontal well when the pressure drop at the toe is small.

In operation, the well 20 is placed in production with the valves 84 (flow regulators) fully open, and the flow rates along the producing interval are measured by the sensors 82 and transmitted to the surface computer system for analysis using the methods previously described. Based on the results of this analysis, the inflow rates in each well section 71–75 of the producing interval are determined. Generally, the goal will be to equalize production inflow per unit length along the interval, and this is accomplished by transmitting commands to individual inflow valves to reduce flow in controllable well sections 71–75 that are showing high inflow. The adjusted flow profile is then derived from the flow measurements again, and further adjustments are made to the valves 84 to flatten the production profile and to try to create a pressure profile like that graphed in FIG. 5 for the uniform inflow case, or to modify a profile into any configuration desired.

The illustrative analysis example described above has been derived for the case of a horizontal well section 24. It will be clear that similar methods may be applied to a long completion in a vertical well or a vertical well section 22, with the same controllable well sections 71–75 and a similar analysis to derive the control strategy from the measurements.

Note that the well management strategy is not assumed to be static. It is to be expected that as a reservoir is depleted the inflow profile will change. The provision of permanent downhole sensors and control devices allows dynamic control of production from controllable well sections to optimize recovery over the full life of the well.

The same methods and principles are applicable to the inverse task of controlled interval injection, where fluids are passed into the tubing and dispersed selectively into a formation interval using controllable well sections in accordance with the present invention, for instance in a water flooding process.

In other possible embodiments of the present invention, a controllable well section 71–75 may further comprise: additional sensors; additional induction chokes; additional electrically controllable valves; a packer valve; a tracer injection module; a tubing valve (e.g., for varying the flow within a tubing section, such as an application having multiple branches or laterals); a microprocessor; a logic circuit; a computer system; a rechargeable battery; a power transformer; a relay modem; other electronic components as needed; or any combination thereof.

The present invention also may be applied to other types of wells (other than petroleum wells), such as a water production well.

It will be appreciated by those skilled in the art having the benefit of this disclosure that this invention provides a petroleum production well having controllable well sections, as well as methods of utilizing such controllable well sections to manage or optimize the well production. It should be understood that the drawings and detailed description herein are to be regarded in an illustrative rather than a restrictive manner, and are not intended to limit the invention to the particular forms and examples disclosed. On the contrary, the invention includes any further modifications, changes, rearrangements, substitutions, alternatives, design choices, and embodiments apparent to those of ordinary skill in the art, without departing from the spirit and scope of this invention, as defined by the following claims Thus, it is intended that the following claims be interpreted to embrace all such further modifications, changes, rearrangements, substitutions, alternatives, design choices, and embodiments.

The invention claimed is:

1. A petroleum well for producing petroleum products comprising:

a perforated section having a plurality of perforated sections in at least a portion thereof extending within a wellbore of said well;

a production tubing extending within said perforated section;

a source of time-varying current at the surface, said current source being electrically connected to at least one of said tubing and said perforated section, such that at least one of said tubing and said perforated section acts as an electrical conductor for transmitting time-varying electrical current from the surface to a downhole location; and a downhole controllable well section comprising, a communications and control module, a sensor, and an electrically controllable valve, said communications and control module being electrically connected to at least one of said tubing and said perforated section, said sensor and said electrically controllable valve being directly electrically connected to said communications and control module, and said electrically controllable valve being adapted to regulate flow between an exterior of said tubing and an interior of said tubing based at least in part on sensor measurements.

2. The petroleum well of claim 1, including an induction choke located about a portion of at least one of said tubing and said perforated section, said induction choke being adapted to route part of said current through said communications and control module by creating a voltage potential within at least one of said tubing and said perforated casing between one side of said induction choke and another side of said induction choke, wherein said communications and control module is electrically connected across said voltage potential.

3. A petroleum well in accordance with claim 1, wherein said downhole controllable well section further comprises: a flow inhibitor located within said perforated section and about said tubing such that fluid flow within said casing from one side of said flow inhibitor to another side of said flow inhibitor is hindered by said flow inhibitor.

4. A petroleum well in accordance with claim 3, wherein said flow inhibitor is a conventional packer.

5. A petroleum well in accordance with claim 3, wherein said flow inhibitor is an electrically controllable packer comprising an electrically controllable packer valve.

6. A petroleum well in accordance with claim 3, wherein said flow inhibitor is an enlarged portion of said tubing.

7. A petroleum well in accordance with claim 3, wherein said flow inhibitor is a collar located about said tubing and within said perforated section.

8. A petroleum well in accordance with claim 1, wherein said sensor is a fluid flow sensor.

9. A petroleum well in accordance with claim 1, wherein said sensor is a fluid pressure sensor.

10. A petroleum well in accordance with claim 1, wherein said sensor is a fluid density sensor.

11. A petroleum well in accordance with claim 1, wherein said sensor is an acoustic waveform transducer.

12. A petroleum well in accordance with claim 1, further comprising: at least one additional downhole controllable well sections, each of said well sections being divided from each other by a flow inhibitor, and each well section comprising a sensor and an electrically controllable valve, said electrically controllable valves of said additional well sections being adapted to regulate flow between said tubing exterior and said tubing interior, said flow inhibitors being located within said perforated sections and about other portions of said tubing such that fluid flow within said perforated sections at each of said flow inhibitors is hindered by said flow inhibitors.

13. A petroleum well in accordance with claim 1, wherein said communications and control module, said sensor, and said electrically controllable valve are housed within a tubing pod, said tubing pod being coupled to said tubing.

14. A petroleum well in accordance with claim 1, wherein said communications and control module includes a modem.

15. A method of producing petroleum from a petroleum well, comprising the steps of:

providing a plurality of downhole controllable well sections of said wells, a number of said well sections comprising a communications and control module, a sensor, an electrically controllable valve, and a flow inhibitor, said flow inhibitor being located within a well casing and about a portion of a production tubing of said well, said communications and control module being electrically connected to at least one of said tubing and said casing such that at least one of said tubing and said casing serve as a source for the communication signal for said communications and control module, and said electrically controllable valve and said sensor being directly electrically connected to said communications and control module;

hindering fluid flow between said well sections within said casing with said flow inhibitors;

measuring a fluid characteristic at each of said well sections with a respective sensor;

regulating fluid flow into said tubing at one or more of said well sections with its respective electrically controllable valve, based on said fluid characteristic measurements; and producing petroleum products from said well via said tubing.

16. A method in accordance with claim 15, further comprising the steps of:

inputting a time-varying current into at least one of said tubing and said casing from a current source at the surface;

impeding said current with an induction choke located about at least one of said tubing and said casing;

creating a voltage potential between one side of said induction choke and another side of said induction choke within at least one of said tubing and said casing;

routing said current through at least one of said communications and control modules at said voltage potential using said induction choke; and powering said at least one of said communications and control modules using said voltage potential and said current from at least one of said tubing and said casing.

17. A method in accordance with claim 16, further comprising the step of communicating with said at least one of said communications and control modules via said current and via at least one of said tubing and said casing.

18. A method in accordance with claim 16, further comprising the step of measuring fluid pressure at one of said well sections with a pressure sensor.

19. A method in accordance with claim 15, further comprising the steps of:

transmitting said fluid measurements to a computer system at the surface using said communications and control module via at least one of said tubing and said casing;

calculating a pressure drop along said well sections, with said computer system, using said fluid measurements;

determining if adjustments are needed for said electrically controllable valves of said well sections;

sending command signals to said communications and control modules of said well sections needing valve adjustment; and adjusting a position of said electrically controllable valve via said communications and control module for each of said well sections needing valve adjustment.

20. A method in accordance with claim 15, wherein said steps of:

regulating fluid flow at each of said well sections to provide a substantially uniform productivity from said at least one petroleum production zone across said well sections; and increasing recovery efficiency from said at least one petroleum production zone.

21. A method in accordance with claim 15, further comprising the step of hindering cross- flow from one permeability layer of said at least one petroleum production zone having a first fluid pressure to another permeability layer of said at least one petroleum production zone having a second fluid pressure, wherein said first pressure is greater than said second pressure.

22. A method in accordance with claim 15, further comprising the step of preventing premature gas breakthrough from gas coning down into said at least one petroleum production zone.

23. A method in accordance with claim 15, further comprising the step of preventing premature water breakthrough from water coning up into said at least one petroleum production zone.

24. A method in accordance with claim 15, further comprising the step of improving a productivity profile of at least one petroleum production zone.

25. A method in accordance with claim 15, further comprising the step of extending a production life of at least one petroleum production zone.

26. A method in accordance with claim 15, further comprising the step of measuring fluid flow at one of said well sections with a fluid flow sensor.

27. A method in accordance with claim 15, further comprising the step of measuring fluid density at one of said well sections with a fluid density sensor.

28. A method of controllably injecting fluid into a formation with a well, comprising the steps of:

providing a plurality of controllable well sections in said well, each of said well sections comprising a communications and control module, a sensor, and an electrically controllable valve, and a flow inhibitor, said communications and control module being directly electrically connected to at least one of said tubing and said casing such that at least one of said tubing and said casing serve as a power supply for said communications and control module, said electrically controllable valve and said sensor being electrically connected to said communications and control module, and said flow inhibitor being located within a well casing and about a portion of a tubing string of said well;

hindering fluid flow between said well sections within said casing with said flow inhibitors;

measuring fluid characteristic at each of said well sections with its respective sensor;

controllably injecting fluid into said tubing; and regulating fluid flow from said tubing interior into said formation at one or more of said well sections with its respective electrically controllable valve, based on said fluid measurements.

29. A method in accordance with claim 28, further comprising the steps of:

inputting AC signal into at least one of said tubing and said casing from a current source at the surface;

impeding said AC signal with an induction choke located about at least one of said tubing and said casing;

routing said AC signal through at least one of said communications and control modules; and powering said at least one of said communications and control modules using said AC signal from at least one of said tubing and said casing.

30. A method in accordance with claim 29, further comprising the step of communicating with said at least one of said communications and control modules via said AC signal and via at least one of said tubing and said casing.

31. A method in accordance with claim 28, further comprising the steps of:

transmitting said fluid characteristic measurements to a computer system at the surface using said communications and control module via at least one of said tubing and said casing;

calculating a pressure drop along said well sections, with said computer system, using said fluid characteristic measurements;

determining if adjustments are needed for said electrically controllable valves of said well sections;

sending command signals to said communications and control modules of said well sections needing valve adjustment; and also if valve adjustments are needed, adjusting a position of said electrically controllable valve via said communications and control module for each of said well sections needing valve adjustment.

32. A method in accordance with claim 28, wherein said step of regulating fluid flow at each of said well sections to provide a substantially uniform injection of fluid from said tubing into said formation across said well sections.

* * * * *